US006732389B2

(12) United States Patent
Drexler

(10) Patent No.: US 6,732,389 B2
(45) Date of Patent: May 11, 2004

(54) BED SHEET WITH TRACTION AREAS

(76) Inventor: Edwin Drexler, Tree Song Dairy, 1806 Swamp Rd., Fabius, NY (US) 13063

( * ) Notice: Subject to any disclaimer, the term of this patent is extended or adjusted under 35 U.S.C. 154(b) by 0 days.

(21) Appl. No.: 10/430,406

(22) Filed: May 7, 2003

(65) Prior Publication Data

US 2003/0221257 A1 Dec. 4, 2003

Related U.S. Application Data

(60) Provisional application No. 60/383,124, filed on May 28, 2002.

(51) Int. Cl.[7] ..... A47G 9/00

(52) U.S. Cl. ..... 5/486; 5/482; 5/495; 5/500; 5/502

(58) Field of Search ..... 5/482, 486, 495, 5/500, 502

(56) References Cited

U.S. PATENT DOCUMENTS 2,779,035 A * 1/1957 McMurry ..... 5/484
3,066,321 A * 12/1962 Kintner ..... 5/498
3,849,813 A * 11/1974 Neilson ..... 5/495
5,148,558 A 9/1992 Dunn
5,306,231 A 4/1994 Cullum et al.
5,542,137 A * 8/1996 Byfield ..... 5/500
5,787,523 A 8/1998 Lindberg
6,013,342 A 1/2000 Neto
6,618,881 B2 * 9/2003 Hart et al. ..... 5/502

* cited by examiner

*Primary Examiner*—Teri Pham Luu
(74) *Attorney, Agent, or Firm*—Richard C. Litman

(57) ABSTRACT

A bed sheet with predetermined regions of friction material for aiding any person, and in particular the elderly, disabled, and frail, in sexual activity and in changing body position, for example, in shifting from lying on the stomach to lying on the back. A traction area across the foot of the bed sheet allows individuals to gain better traction with their feet, ankles, and legs. Any substance may be used to make the traction areas, including mildly abrasive materials in a flexible matrix, latex, and hypoallergenic plastic. The bed sheet with traction areas is washable and, preferably, non-allergenic. The traction areas may blend with the color and composition of the sheet so that the effect is esthetically pleasing.

5 Claims, 8 Drawing Sheets

BED SHEET WITH TRACTION AREAS

CROSS-REFERENCE TO RELATED APPLICATION

This application claims the benefit of U.S. Provisional Patent Application Serial No. 60/383,124, filed May 28, 2002.

BACKGROUND OF THE INVENTION

1. Field of the Invention

The present invention relates generally to bedding, and more specifically to an area at the foot of a bed sheet that gives the feet and legs better traction, improving movement used in sexual activity and other movement, such as turning over in bed.

2. Description of Related Art

Devices addressing the difficulty facing senior citizens, the ill, and the disabled in changing their physical positions in bed are well known in the art. Many of these devices see the problem as stemming from friction, the force of friction being seen as a limitation, and a force to be reduced rather than one to enhance.

U.S. Pat. No. 5,787,523, issued to Eva Lindberg in 1998, discloses a low friction bed sheet for facilitating changing the position of a person or part of a person in a prone position. The '523 patent further discloses surfaces of higher friction adjacent to the low friction surfaces, the transition zones between the low friction surfaces and the high friction surfaces being lengthwise in the bed and perceivable by the person in the bed.

Similarly, U.S. Pat. No. 5,148,558, issued to Dunn in 1992, describes a patient transfer sheet device having surfaces of both low and higher coefficients of friction, whereby patients may be moved from one bed or gurney to another. As in the aforementioned patents, the '558 patent is a device to reduce frictional forces related to bed sheets rather than to increase the coefficient of friction or traction.

Devices that increase the coefficient of friction in a surface are also well represented in the art. However, their presence has for the most part been limited to non-bed applications. U.S. Pat. No. 6,013,342, issued to Neto in 2000, describes a self-adhesive sheet of non-slip material such as latex foam. Strips can be cut from the roll and adhered to other surfaces. Although the device is described as having "multiple uses," it is intended primarily as a carpet liner or acoustic coating and does not disclose purpose or structure related for use in a bed.

Although U.S. Pat. No. 5,306,231, issued to Cullum in 1994, discloses an apparatus having a sheet with a high-friction surface, the device relates to a medical traction system for a patient in bed, intended to apply a longitudinal stretching force to the body. Furthermore, the frictional surface is a single sheet of uniform construction, without sections of material with varying coefficients of friction.

None of the above inventions and patents, taken either singly or in combination, is seen to describe the instant invention as claimed.

SUMMARY OF THE INVENTION

The bed sheet with traction areas is an aid to provide greater mobility for people in bed, and in particular, during sexual activity. The present invention is a bed sheet having a region at, or near, the foot of a bed sheet having a greater coefficient of friction than the remainder of the sheet. The areas of greater traction may be formed by one or more traction strips integrated with the bed sheet or applied to the bed sheet.

The present invention aids any user in sexual movement and in general mobility in bed, but has particular utility for aiding the elderly, disabled, and frail in sexual movement and in changing position, for example, in shifting from lying on the stomach to lying on the back.

The area of greater coefficient of friction allows individuals to gain better traction with their feet, ankles, and legs, thereby aiding in both the longitudinal motion during sexual activity and in the rotational motion needed to turn the body.

The invention is suitable for any individual but is particularly helpful to the elderly, ill, disabled or anyone of diminished physical strength.

The friction, or traction-supplying surface is suitable for all types of sheet material, and is particularly advantageous for slippery cloth, such as silk and satin. Because the area of greater coefficient of friction may be made to visually blend with the remainder of the sheet, the present invention retains the esthetic appeal of consumer bed linen.

The traction area may be an integral part of the sheet, as would be the case with a high-friction texture or pattern. The traction area may also be composed of a material applied to the sheet, such as a coating. The traction area may also take the form of removable traction material attached to the sheet with a nonpermanent adhesive material or a removable fastener device.

The traction strip may be comprised of any material and created by any method known in the art. Regardless of the material or manufacturing method, the traction strip is soft, pleasant to the touch, washable and, preferably, non-allergenic.

Accordingly, it is a principal object of the invention to provide an aid to the motion used in sexual activity by providing better traction for the feet, ankles, and legs in the form of a bed sheet having a traction area at the foot end of the sheet.

It is another object of the invention to provide an improved device for aiding movement in bed by providing better traction for the feet, ankles, and legs.

It is another object of the invention to provide an improved device for aiding persons in bed in rolling over by providing better traction for the feet, ankles, and legs.

It is a further object of the invention to provide an improved device for avoiding bedsores by making it easier for a person with diminished physical strength to change their position in bed.

It is another object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

The present invention is a bed sheet with traction areas for providing increased mobility in bed. The traction area allows an individual to gain better purchase on the sheet with the feet and legs, facilitating movement in line with the head and the foot of the bed, thus aiding in sexual activity.

Figure 1:
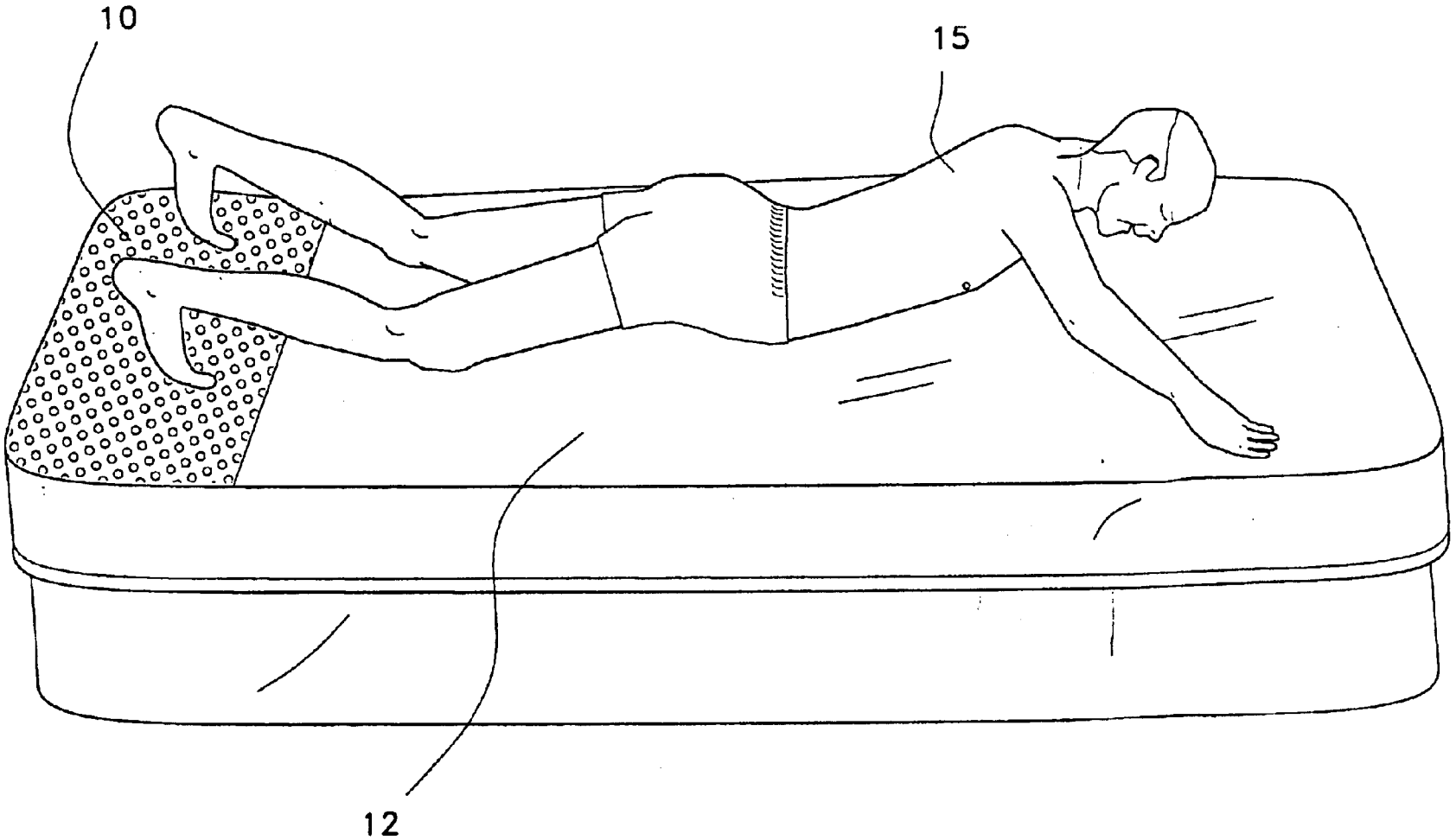
FIG. 1 is an environmental perspective view of a first embodiment of a bed sheet with traction areas according to the present invention.

As shown in FIG. 1, a strip of high friction material 10 is applied to, or is integrated into, the surface of a bed sheet 12 at the foot section of the sheet and extends all the way to the edge of the bed.

In addition, the traction region 10 aids in other movement, such as pushing with the feet, thereby permitting an individual 15 to rotate his or her body with less effort and change from lying on one side of the body to lying on another.

Figure 2:
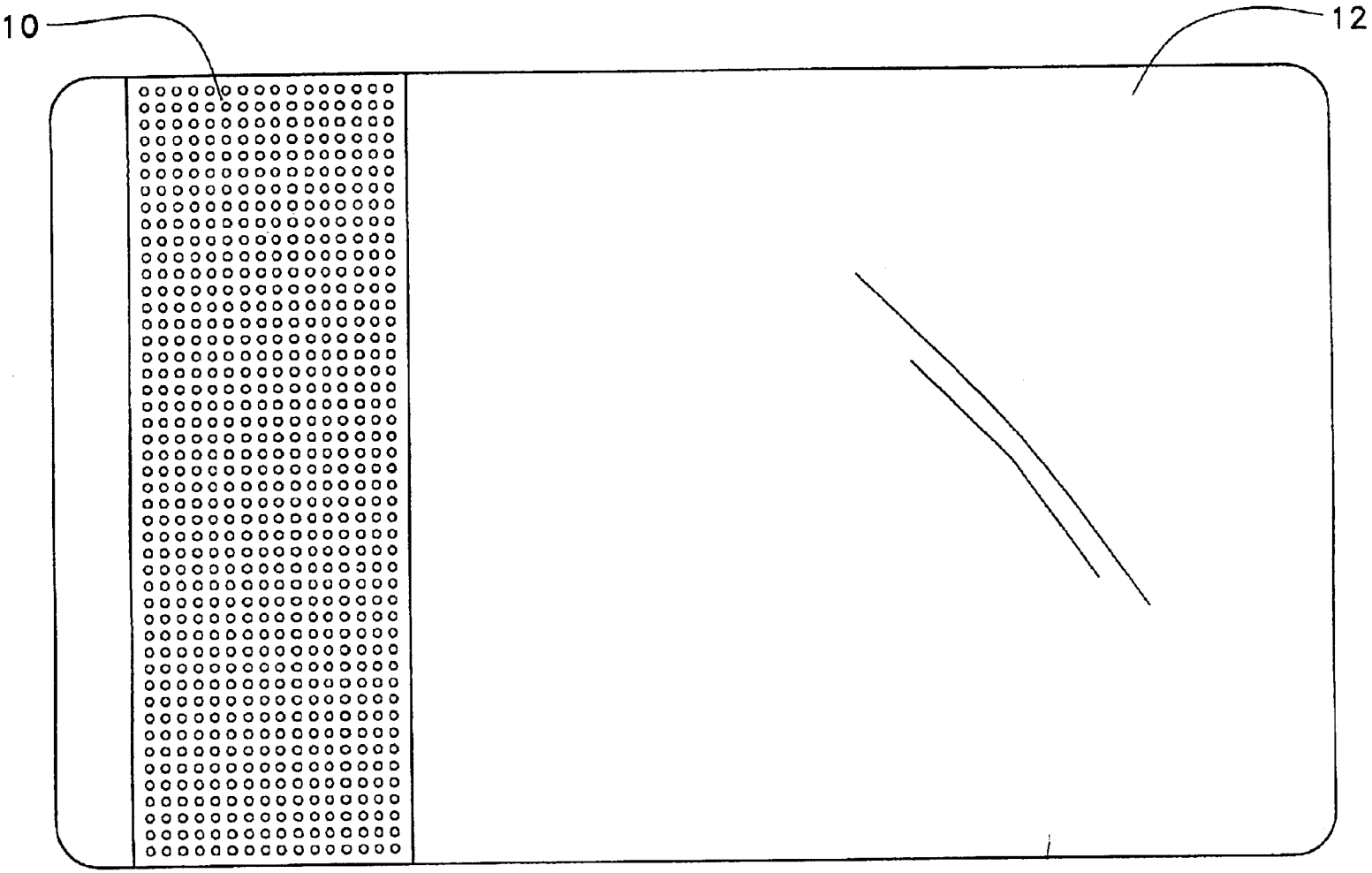
FIG. 2 is a top plan view of a second embodiment of a bed sheet with traction areas according to the present invention.

FIG. 2 illustrates a second embodiment of the present invention in which the traction strip 10 disposed at the foot of a bed sheet 12 stops short of the edge of the bed sheet 12.

The traction region may be formed by any material, including latex, plastic, mildly abrasive materials embedded in a flexible matrix, alteration of the texture and thickness of the sheet itself, and sandwiching a texture material between two layers of cloth or any number of layers of any substance used to make sheets.

The traction area may be an integral part of the sheet, as would be the case with a high-friction texture or pattern. The traction area may also be composed of a material applied to the sheet, as would be the case with:

(a) a coating applied as a liquid and which subsequently dries to a solid, and (b) a matrix containing mildly abrasive material that is applied as a liquid and which subsequently dries to a solid.

The traction area may also take the form of removable traction material attached to the sheet with attachable/removable fastening means such as:

(a) hook-and-loop fasteners;

(b) tacky or sticky, but not permanent, adhesive;

(c) high-friction material attached to the sheet with buttons and loops; and (d) high-friction material attached to the sheet with zippers.

Figure 3:
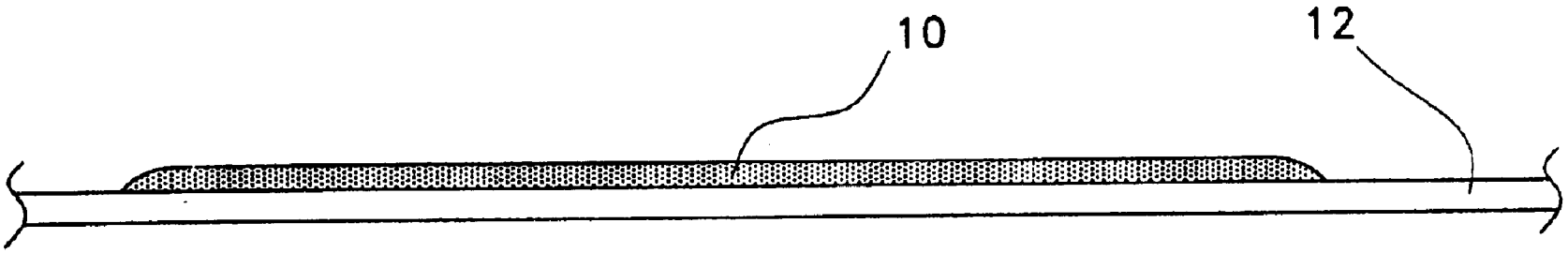
FIG. 3 is a fragmented side view of another embodiment of a bed sheet with traction areas according to the present invention, showing a film of high-friction material bonded to the surface of a sheet.

FIG. 3, a fragmented side view of another embodiment, shows a film of high friction material 10 bonded to the surface of a sheet 12.

Figure 4:
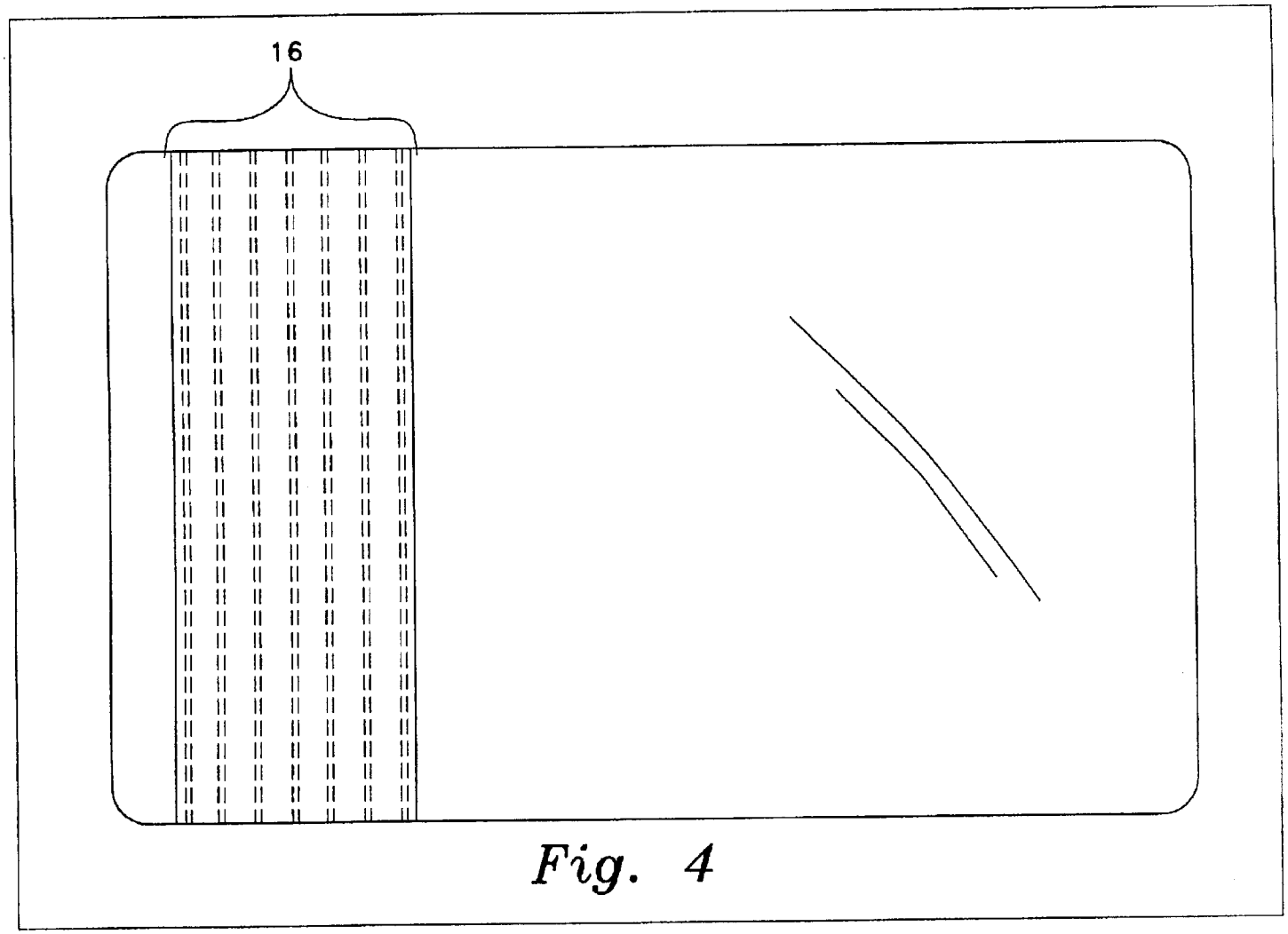
FIG. 4 is a top plan view of a fourth embodiment of a bed sheet with traction areas, according to the present invention.
Figure 5:
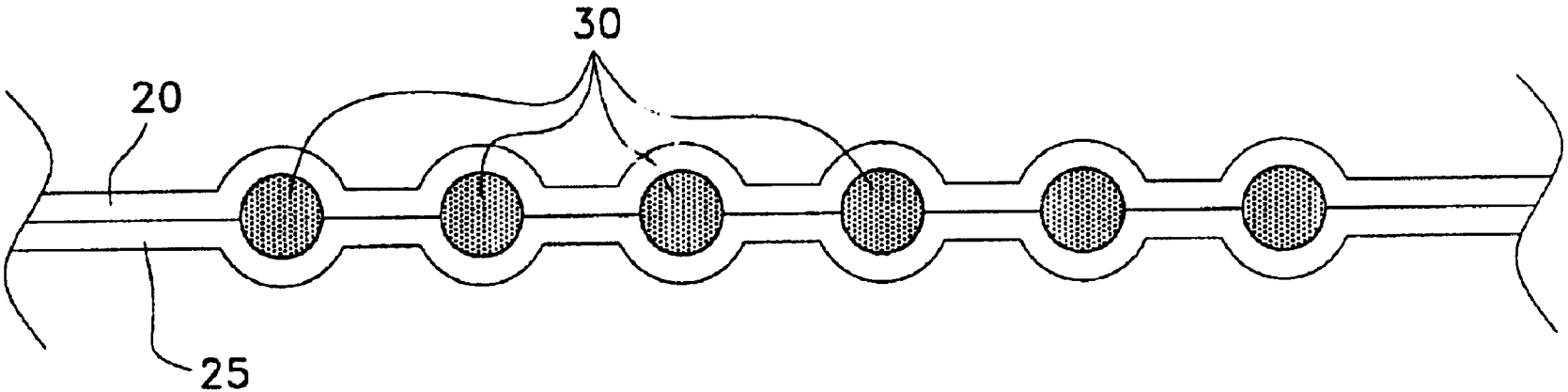
FIG. 5 is a broken away, detail, side view of the bed sheet with traction areas shown in FIG. 4.

In the embodiment of FIG. 4, rows of ribbing 16 are stitched between two layers of bed sheet material. As shown in FIG. 5, the rows of ribbing 16 of FIG. 4 may comprise soft ribbing 30 stitched between layers 20, 25 of sheet material.

The traction area is not limited to the texture pattern depicted in FIG. 5. Any suitable pattern, texture, or padding may be used to create a traction region.

Figure 6A:
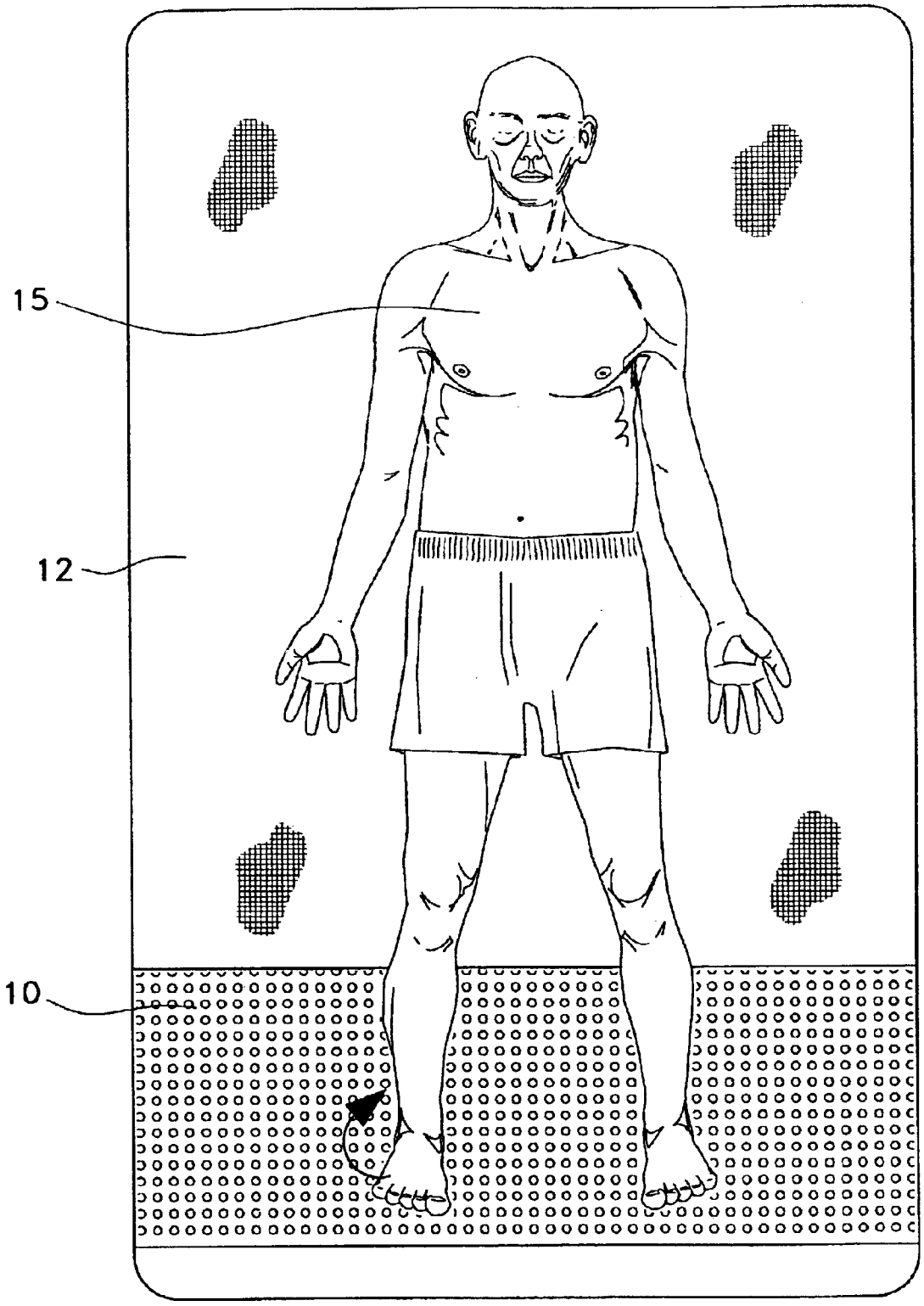
FIG. 6A is an environmental top view, showing an individual lying supine, applying downward force on a traction strip with the right leg and foot, to begin turning over the body.
Figure 6B:
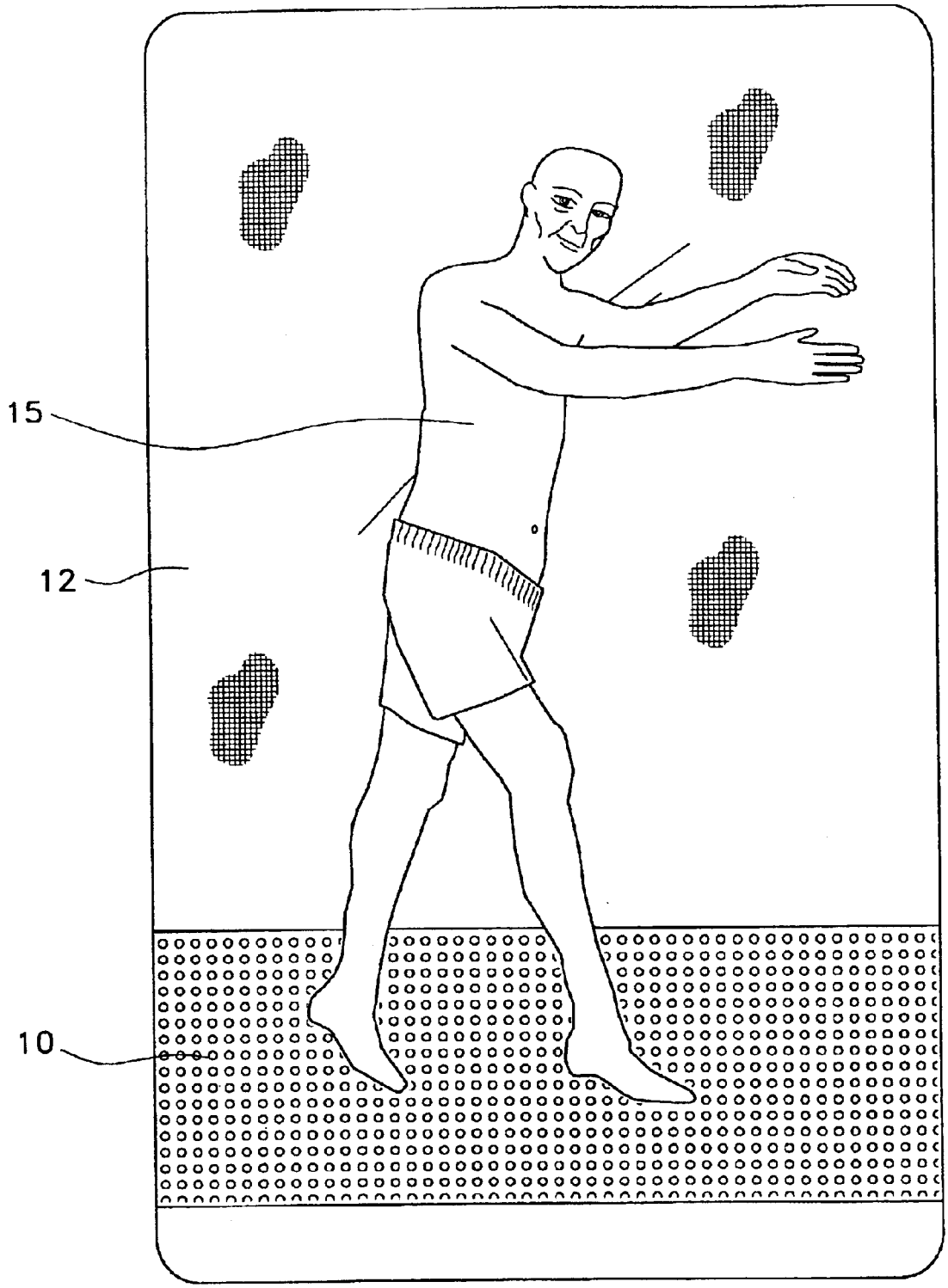
FIG. 6B is a continuation of the environmental view in FIG. 6A, showing the individual halfway through rolling his body over from front to back.
Figure 6C:
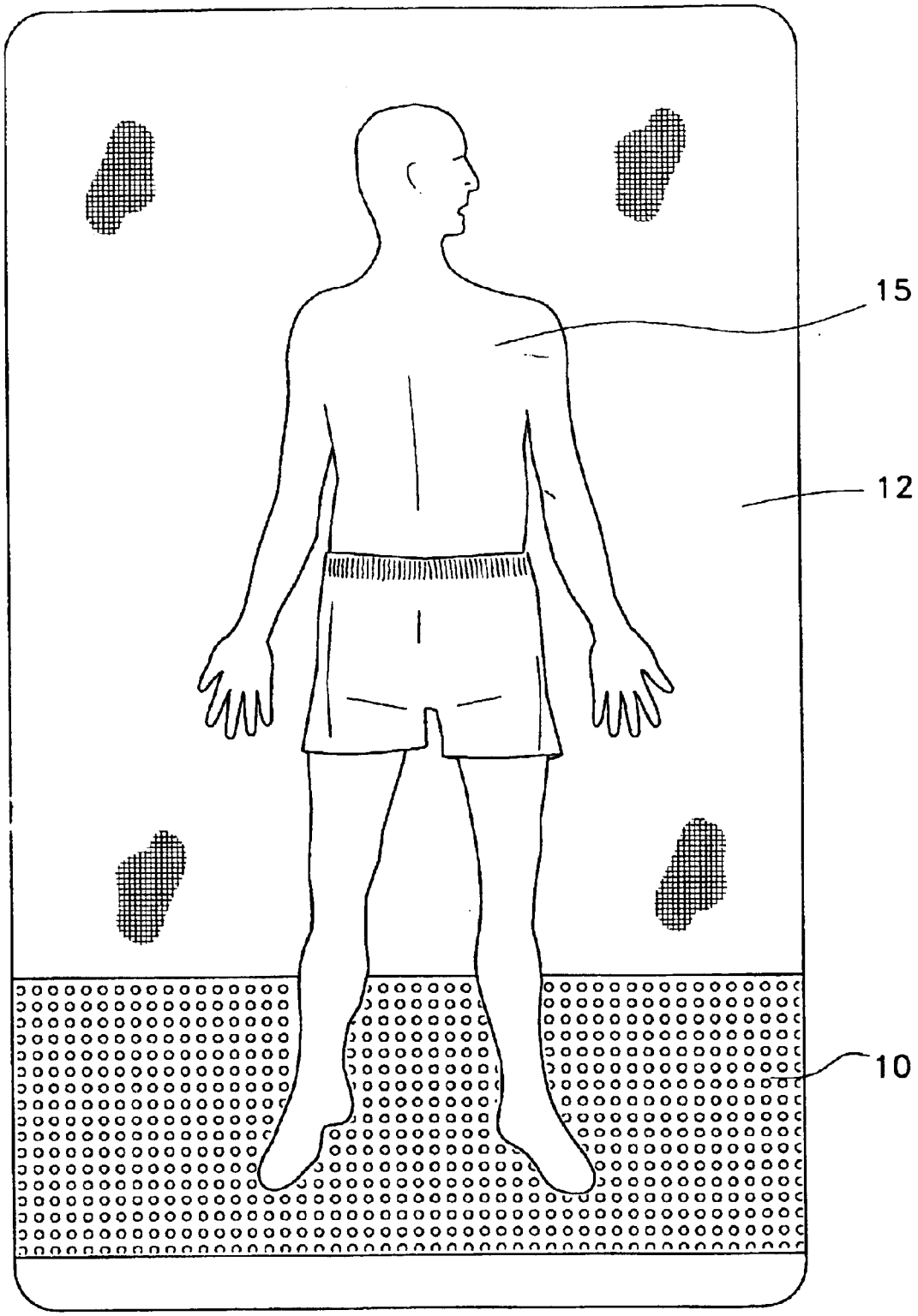
FIG. 6C is a continuation of the environmental view shown in FIGS. 6A and 6B, showing the individual after turning over in bed.

FIG. 6A–C shows a sequence of events in which an individual 15, lying supine on a bed sheet 12 with his feet resting on the traction area 10, uses the traction area 10 to rotate their body. The individual 15 applies downward pressure on the traction area 10 with one foot, to begin rotating his body. In FIG. 6B, the individual 15 is halfway through a 180 degree rotation of his body, and is now on his side. By continuing to apply downward force on the traction area 10 with one foot, the individual 15 completes the roll, and as shown in FIG. 6C, is now in a face down, prone position.

The friction, or traction, area can be made of any material or substance, and can be made by any method. The present invention does not require the use of unusual or exotic materials or manufacturing methods and thus should promote wide availability at economical prices. Such flexibility will allow adaptation to any material or substance that can be used to make sheets and to any manufacturing approach that produces the desired high-traction region. Because the friction area may be made to blend with the color and texture of the sheet material, the immediate invention remains esthetically pleasing.

A number of readily available substances may be used to make the traction strip, including latex, plastic, mildly abrasive materials embedded in a flexible matrix, alteration of the surface and texture of the sheet material itself, and fastening a textured material between two or more layers of sheet cloth or any other substance used to make sheets. The finish of the traction area may be textured, patterned, or indistinguishable from the appearance of the remainder of the bed sheet.

The present invention is suitable for a wide variety of cloth normally used to make bed sheets. The traction strip is washable and, preferably, non-allergenic. The traction strip may be made to blend in with the color and composition of the sheet so that it does not detract from the appearance of the bedclothes.

Because both the traction supplying material and the method of its attachment to the sheet require no exotic substances nor unusual manufacturing techniques, manufacturing costs should be contained, making the invention more affordable for the disabled and the elderly.

It is to be understood that the present invention is not limited to the sole embodiments described above, but encompasses any and all embodiments within the scope of the following claims.

I claim:

1. A bed sheet with traction areas, comprising:

a sheet of fabric material defining a bed sheet having a foot end; and a traction area at the foot end of said bed sheet having a higher coefficient of friction than the remainder of the sheet, wherein said traction area includes a plurality of rows of ribbing disposed between two sheet layers.

2. The bed sheet with traction areas according to claim 1, wherein the traction area is indistinguishable from the remainder of the sheet.

3. The bed sheet with traction areas according to claim 1, wherein the traction area is distinct in appearance from the remainder of the sheet.

4. The bed sheet with traction areas according to claim 1, wherein the traction area is pleasant to the touch and non-allergenic.

5. The bed sheet with traction areas according to claim 1, wherein the traction area is washable.

* * * * *